US006327425B1

(12) United States Patent
Strobel

(10) Patent No.: US 6,327,425 B1
(45) Date of Patent: Dec. 4, 2001

(54) REGULATOR FOR HEATING AND AIR CONDITIONING APPLIANCES IN MOTOR VEHICLES

(75) Inventor: Henry Strobel, Sulzbach (DE)

(73) Assignee: Mannesmann VDO AG (DE)

( * ) Notice: Subject to any disclaimer, the term of this patent is extended or adjusted under 35 U.S.C. 154(b) by 0 days.

(21) Appl. No.: 09/524,188

(22) Filed: Mar. 13, 2000

(30) Foreign Application Priority Data

Mar. 12, 1999 (DE) ..... 199 11 036

(51) Int. Cl.[7] ..... H02P 7/29
(52) U.S. Cl. ..... 388/934; 388/912; 318/471
(58) Field of Search ..... 318/430–433, 318/459, 463, 471; 388/909, 912, 934

(56) References Cited

U.S. PATENT DOCUMENTS 4,376,894 * 3/1983 Vogler ..... 378/110
5,966,001 * 10/1999 Maehara et al. ..... 322/28
6,021,252 * 2/2000 Faris et al. ..... 388/831
6,054,823 * 4/2000 Collings et al. ..... 318/439

* cited by examiner

*Primary Examiner*—Robert E. Nappi
*Assistant Examiner*—Rita Leykin
(74) *Attorney, Agent, or Firm*—Robert J. Depke; Mayer, Brown & Platt

(57) ABSTRACT

A regulator for heating and air-conditioning appliances in motor vehicles, having a suction fan which is driven by an electrically commutated DC motor and in whose induction air flow a temperature measurement sensor is arranged. A disturbance in motor running which may lead to an incorrect temperature measurement is detected at an early stage by providing measurement means which, in two time intervals, determine measurements that are proportional to the frequency of the motor voltage, and compare these measurements with one another.

14 Claims, 2 Drawing Sheets

REGULATOR FOR HEATING AND AIR CONDITIONING APPLIANCES IN MOTOR VEHICLES

BACKGROUND OF THE INVENTION

1. Field of the Invention

The present invention relates generally to field of automated controls. More specifically, the present invention is directed to a regulator for heating and air-conditioning appliances in motor vehicles. The device employs a suction fan which is driven by an electrically commutated DC motor and a temperature measurement sensor arranged in the induction air flow.

2. Description of the Related Art

Regulators for heating and air-conditioning appliances are used to determine the interior temperature in motor vehicles. In these devices, an electrically powered suction fan is used to suck air out of the interior of the vehicle and to move it past a temperature measurement sensor. The temperature measured by the temperature measurement sensor is used to regulate the heating and air-conditioning appliance. Since only a small amount of air is sucked out of the passenger compartment, low-power electrically commutated DC motors are used to drive the suction fan, and also have the advantage that they produce little noise.

In order to ensure that the electrically commutated DC motor starts reliably, it is known for appropriate motors to be used whose starting is ensured by means of an integrated Hall sensor. However, Hall sensors are relatively expensive components. German Patent Application DE 43 40 580 furthermore discloses a regulator for heating and air-conditioning appliances, in which there is no Hall sensor.

In order, nevertheless, to ensure that the electrically commutated DC motor starts reliably, this invention proposes that an interrupter be arranged in the circuit of the DC motor. The interrupter is actuated by a timer and is used to interrupt the motor supply voltage cyclically, in a pulsed manner. As a result of this measure, when the supply voltage is built up once again in the starting phase, the motor receives rotation impulses at regular time intervals, which ensure starting by virtue of their continual repetition.

The mass inertia of the rotating fan bridges the current interruption, which lasts for only fractions of a second, so that there is no reduction in the measured air flow sufficient to adversely affect the measurement results in any way, and the motor is not overloaded. However, if the motor fails to start despite these measures, or if the motor remains stationary during operation for any reason whatsoever, then this results in no air being conveyed out of the interior of the vehicle or past the temperature measurement sensor. Consequently, the air-conditioning regulating process is based on an incorrect actual value of the internal temperature.

SUMMARY OF THE INVENTION

The present invention overcomes these shortcommings and provides an improved regulator for heating and air-conditioning appliances in motor vehicles, in which the lack of any drive for the suction fan from the DC motor is identified at an early stage. A further object of the invention is to provide a method for operating an electrically commutated DC motor which can be used in the abovementioned regulator. Other objects and advantages will be apparent from the following description set forth below.

At the very least, the first-mentioned object is achieved, for a regulator of this generic type for heating and air-conditioning appliances in motor vehicles wherein the regulator has measurement means, which are connected to the actuation electronics and to the drive winding of the motor for determining a first and a second measurement. In this embodiment, the first measurement is proportional to a first frequency f1 of the cyclic voltage on the drive winding of the DC motor in a first time interval $\Delta t1$, and the second measurement is proportional to a second frequency f2 of the cyclic voltage on the drive winding of the DC motor in a second time interval $\Delta t2$.

In this case, the expression "measurements proportional to a frequency" also means those which are inversely proportional to the frequency.

With the regulator according to the invention, a cyclically varying voltage occurs on the drive winding during operation, in a manner known per se. As is known from DE 43 40 580, this motor voltage may be briefly interrupted. After the end of the interruption, the motor thus receives a new pulse when the voltage starts once again, which acts as a starting pulse on a stationary motor. However, in an equivalent manner, it is also possible not to interrupt the voltage, but to leave it briefly at a constant voltage level. This once again results in the motor briefly receiving no drive energy. With this process as well, the motor then receives starting pulses as a result of the subsequent voltage change. In accordance with the invention, it is possible to make a determination of measurements which are proportional to the frequency of the voltage on the drive winding at different times. The invention provides a reliable means to identify whether the motor is being supplied with drive energy.

One alternate exemplary embodiment of the regulator according to the invention provides for the motor voltage to be briefly and cyclically interrupted throughout the entire motor running time, or cyclically to be briefly kept at a constant voltage level. In this case, the first time interval $\Delta t1$ preferably directly follows the time interval when the voltage on the drive winding of the DC motor is briefly switched off or constant, and measurements proportional to the frequency are determined and evaluated at different time intervals $\Delta t1$ and $\Delta t2$.

If the frequency in the second time interval $\Delta t2$ is greater than the frequency in the first time interval $\Delta t1$, then it can be assumed that the motor is running reliably. If this condition is not satisfied, then starting pulses can be supplied to the motor once again, in the known manner.

Furthermore, a comparator is provided for comparison of the frequency-proportional measurements, and thus may be used for evaluation. The comparator supplies an output signal which is a function of the comparison of the frequency-proportional measurements in the time intervals $\Delta t1$ and $\Delta t2$. Starting pulses for the DC motor can then be generated, if necessary, as a function of the output signal from the comparator.

In the regulator according to the invention, it is not only possible to use the known electrically commutated DC motors with an integrated Hall sensor, but also to use electrically commutated DC motors without a Hall sensor, which have an auxiliary winding in addition to the drive winding.

The method according to the invention for operating an electrically commutated DC motor, in which the DC motor is supplied with a cyclically varying voltage and the cyclic variation of the voltage is briefly switched off at times is distinguished by a first measurement being determined in a first time interval $\Delta t1$. This measurement is proportional to the frequency f1 of the voltage in the time interval Δt1. A second measurement is determined in a subsequent time interval Δt2. The second measurement is proportional to the frequency f2 of the voltage in the time interval Δt2.

The first and second measurements, which are proportional to the frequencies f1 and f2, are preferably compared with one another. A starting signal is supplied to the motor when the second measurement, which is proportional to the frequency f2, is less than or equal to the first measurement, which is proportional to the frequency f1. In the case of measurements which are inversely proportional to the frequency, the same statements apply in the opposite sense.

In one preferred embodiment, the invention provides for the rotation speed of the DC motor to be determined from at least one of the measurements which are proportional to frequency f1 or f2.

BRIEF DESCRIPTION OF THE DRAWINGS

The invention will be described in more detail in the following text with reference to an exemplary embodiment and the drawings, wherein.

DETAILED DESCRIPTION OF THE PREFERRED EMBODIMENT

Figure 1:
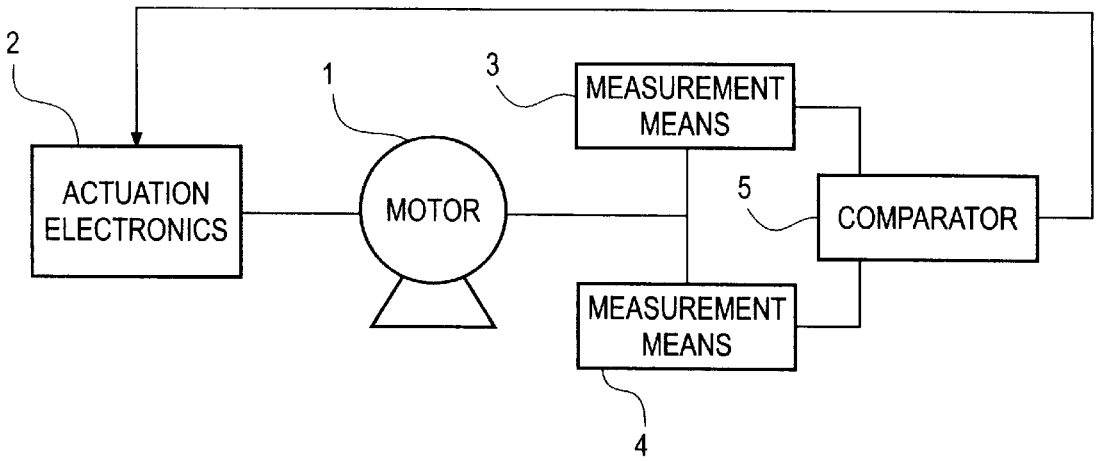
FIG. 1 illustrates a motor and its associated electronics.

FIG. 1 shows, schematically, the electrically commutated DC motor 1 together with the corresponding electrical components. The motor 1 is electrically actuated by actuation electronics 2. The voltage on the drive winding of the motor 1 is tapped off, and is supplied to the measurement means 3, 4, which generate a measurement, proportional to the frequency of the motor voltage, within a time interval Δt1 or Δt2.

There are various operations for doing this, which are known per se. For example, the time from one maximum of the voltage profile to the next maximum of the voltage profile can be recorded. Alternatively, it is possible to record the time from one voltage maximum to the next voltage minimum. Alternatively, it is possible to start from any desired voltage value and to record the time until this particular voltage value is reached once again. In order to improve the measurement accuracy, the measurement may also be extended over a number of cycles. Furthermore, a time interval Δt1 or Δt2 may also be split into subintervals, and the measurements may be averaged over the individual sub-intervals.

In all cases, an integrator which integrates a DC voltage may be started, for example at the commencement of a time interval. The integration is ended at the end of the time interval. The reciprocal of the integrated DC voltage is then proportional to the frequency of the voltage applied to the motor. It is also possible to dispense with forming the reciprocal.

There is no need to know the absolute frequency value, since all that is of interest is how the frequency changes as the time duration increases. Thus, to do this, it is sufficient to know the frequency-proportional signals obtained in the time intervals Δt1 and Δt2.

The means for determining the frequency-proportional measurements may also include a single measurement means as well as a storage element for storing the measurements in the time interval Δt1 or Δt2.

Furthermore, a comparator 5 is provided to compare the frequency-proportional signals obtained by the measurement means 3, 4. The output signal from the comparator 5 is supplied to the actuation electronics 2. Depending on the output signal from the comparator 5, the actuation electronics 2 generate a starting voltage, when required. To do this, the cyclically varying voltage is briefly interrupted or is kept at a constant voltage level. The subsequent voltage pulse leads to the DC motor being started.

Figure 2:
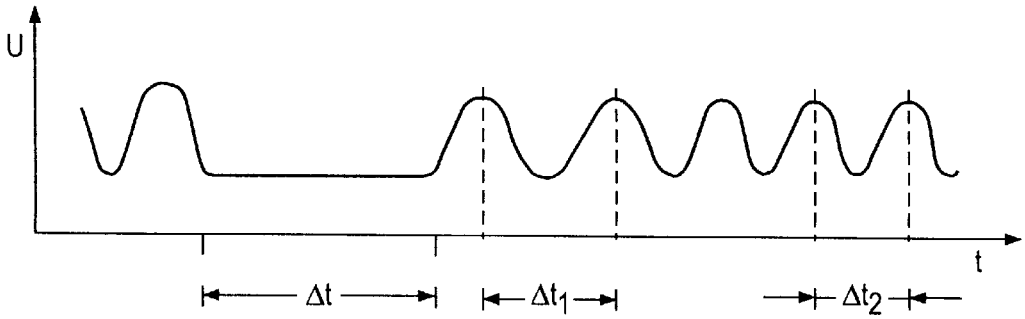
FIG. 2 illustrates the profile of the signal voltage plotted against time.

FIG. 2 shows the voltage profile on the drive winding of the motor 1. The cyclically varying voltage is interrupted for a short time period ΔtPause, or is kept at a constant value. The motor receives a starting pulse from the voltage pulse at the end of the time interval ΔtPause. A measurement that is proportional to the voltage frequency is then determined in a first time interval Δt1. The same applies to a subsequent time interval Δt2. The measurements determined in the two time intervals provide information as to whether the motor is running correctly. If the frequency in the time interval Δt2 is greater than the frequency in the time interval Δt1, then it can be assumed that the motor is running correctly. On the other hand, if the frequency in the time interval Δt2 is less than or equal to the frequency in the time interval Δt1, then this means that the rotation speed of the motor is decreasing, and it is not running correctly. If this situation is detected, then the actuation electronics 2 can output another starting pulse to the motor at an early stage. Starting pulses are likewise output if the frequencies detected in the two time intervals are the same. To do this, the voltage on the drive winding of the motor is once again briefly interrupted, or set to a constant value. This early action allows any disturbance in the motor running to be prevented at an early stage as well, thus preventing corruption of the measurements on a temperature measurement sensor.

Figure 3:
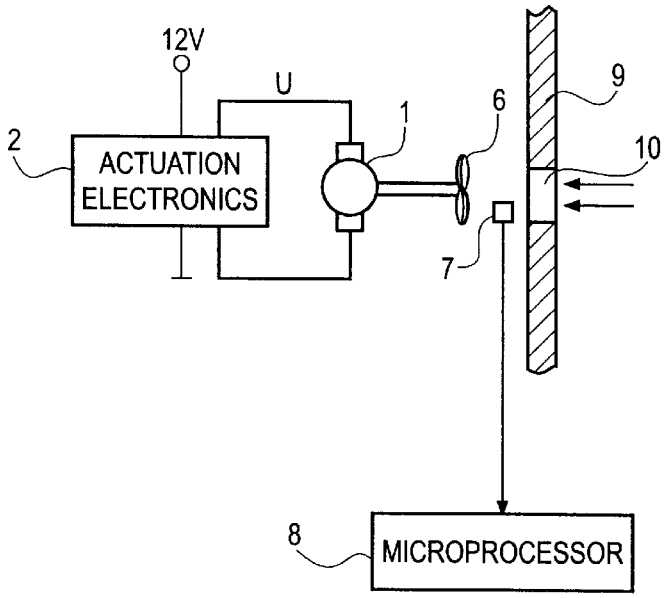
FIG. 3 illustrates a complete regulator.

FIG. 3 shows the complete regulator. It is comprised of the electrically commutated DC motor 1, which is supplied from the actuation electronics 2. An impeller 6 is mounted on the shaft of the motor 1 and moves air past a temperature measurement sensor 7, from the interior of the motor vehicle. The DC motor 6 and impeller 6 in this case form a suction fan. The temperature measurement sensor 7 is connected to a microprocessor 8, which is used to control the air-conditioning system. The complete regulator is arranged, for example, behind a front panel 9 of the controller of the heating and air-conditioning system, with the front panel 9 having an opening 10 through which the air is sucked out of the interior of the motor vehicle.

Figure 4:
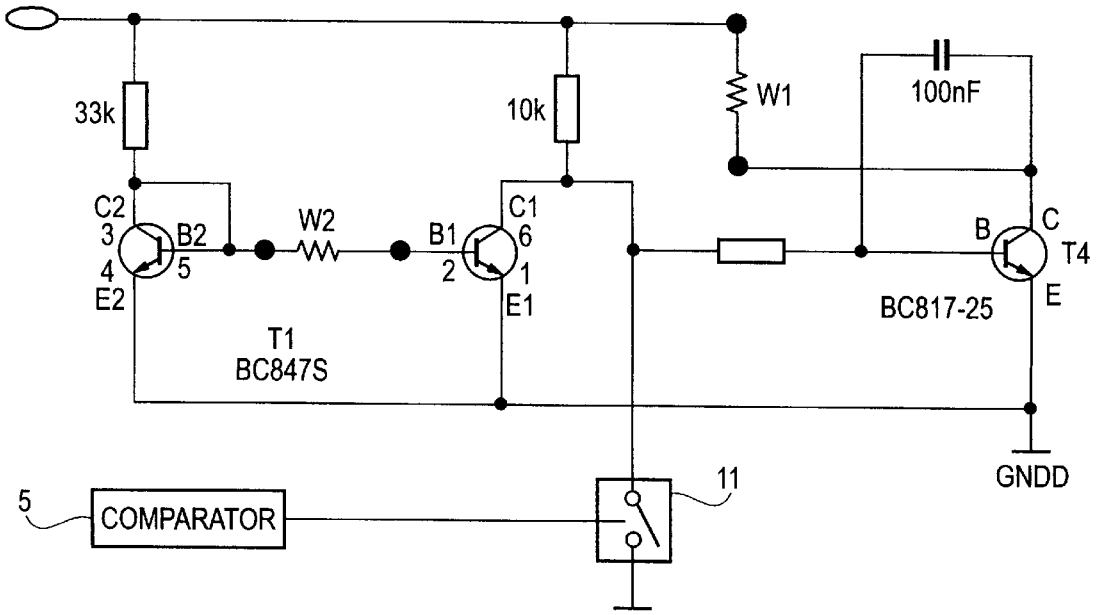
FIG. 4 illustrates an electric circuit for activation of the motor.

FIG. 4 shows an actuation circuit for the electrically commutated DC motor. The actuation circuit supplies the drive winding W1 of the DC motor with a voltage that varies with time. An auxiliary winding W2 is required to produce this voltage. The drive winding W1 is set in motion by applying a voltage to it. This induces a voltage in the auxiliary winding W2 which, via the illustrated circuit comprising transistors T, resistors R and capacitors C, now produces the voltage, which varies with motor rotation, on the drive winding W1 in a manner known per se. A corresponding circuit is used, for example, to operate the S 2000 sensor fan from Pabst-Motoren GmbH, Sankt Georgen. The illustrated circuit, which is known per se, is, according to the invention, connected to the comparator 5 via an intelligent switch 11, which can briefly interrupt the voltage on the drive winding of the motor in order to generate a starting pulse.

What is claimed is:

1. A regulator for temperature control comprising:

a fan driven by a DC motor and a temperature sensor arranged in an air flow of the fan;

actuation electronics which supply the DC motor with a starting voltage and a cyclically varying voltage; and measurement means connected to a drive winding of the motor, for determining a first and a second measurement, wherein the first measurement is related to a first frequency f1 of the cyclic voltage on the drive winding of the DC motor in a first time interval Δt1, and the second measurement is related to a second frequency f2 of the cyclic voltage on the drive winding of the DC motor in a second time interval Δt2.

2. The regulator as claimed in claim 1, wherein, the cyclically varying voltage on the drive winding is briefly interrupted in a time interval ΔtPause or is kept at a constant voltage level.

3. The regulator as claimed in claim 2, wherein the first time interval Δt1 immediately follows a time interval ΔtPause with an interrupted voltage or a voltage at a constant level.

4. The regulator as claimed in claim 1, wherein the voltage on the driving winding is briefly interrupted at regular intervals, or is kept at a constant voltage level.

5. The regulator as claimed in claim 1, further comprising a comparator for comparison of the frequencies f1 and f2.

6. The regulator as claimed in claim 5, wherein the output signal from the comparator is connected to the actuation circuit, and a starting voltage is produced by the actuation circuit as a function of the output signal from the comparator.

7. The regulator as claimed in in claim 1, wherein the DC motor further includes an integrated Hall sensor.

8. The regulator as claimed in claim 1, wherein the DC motor further includes an auxiliary winding connected to the actuation electronics.

9. The regulator of claim 1 wherein the first and second measurements are inversely proportional to the frequencies f1 and f2.

10. A method for operating a DC motor comprising the steps of:

supplying the DC motor with a cyclically varying voltage; and during a first time interval Δt1, making a first measurement which is related to a frequency f1 of the voltage in the time interval Δt1 and, during a subsequent time interval Δt2, making a second measurement which is related to a frequency f2 of the voltage in the time interval Δt2.

11. The method as claimed in claim 10, comprising the additional step of comparing the first and second measurements, which are proportional to the frequencies f1 and f2.

12. The method as claimed in claim 10, comprising the step of determining a rotation speed of the DC motor based on at least one of the measurements which are proportional to the frequencies f1 or f2.

13. The method as claimed in claim 10, wherein the first and the second measurements are inversely proportional to the frequencies f1 and f2, respectively.

14. The method as claimed claim 10, wherein the cyclic variation of the voltage is switched off briefly when the second measurement, which is proportional to the frequency f2, is less than or equal to the first measurement, which is proportional to the frequency f1.

* * * * *